US005750077A

United States Patent [19]

Schoen

[11] Patent Number: 5,750,077

[45] Date of Patent: May 12, 1998

[54] COMPACT MAN-PORTABLE EMERGENCY OXYGEN SUPPLY SYSTEM

[76] Inventor: Neil C. Schoen, 9817 Freestate Pl., Gaithersburg, Md. 20879

[21] Appl. No.: 685,969

[22] Filed: Jul. 22, 1996

[51] Int. Cl.[6] ..... A62B 7/08

[52] U.S. Cl. ..... 422/122; 422/199; 422/305

[58] Field of Search ..... 422/120, 122, 422/199, 305

[56] References Cited

U.S. PATENT DOCUMENTS

| | | | |
|---|---|---|---|
| 3,773,044 | 11/1973 | Wallace | 128/142.6 |
| 4,230,667 | 10/1980 | Williams | 422/113 |
| 4,671,270 | 6/1987 | Kato | 128/202.26 |
| 5,198,147 | 3/1993 | Zhang et al. | 252/187.31 |
| 5,338,516 | 8/1994 | Zhang et al. | 422/126 |

*Primary Examiner*—Nina Bhat

[57] ABSTRACT

A man-portable light weight emergency oxygen supply system device for providing breathable oxygen for periods exceeding ten minutes. The device can be easily affixed to personnel for mobile use or mounted for stationary applications. A typical on-person system, weighing over three pounds, can supply pure oxygen for short periods of time, extending to the order of an hour for mixtures with ambient air to provide nominal sea-level oxygen concentrations. A catalyzed endothermic reaction is utilized to produce oxygen with no potential for harmful contaminants or danger of accidental initiation or fire/explosion hazard. Potential applications include use for emergency evacuations, such as hotel fires, aviation emergencies including de-pressurization and fires, and medical emergencies requiring oxygen administration prior to arrival of emergency medical equipment or ambulances.

10 Claims, 3 Drawing Sheets

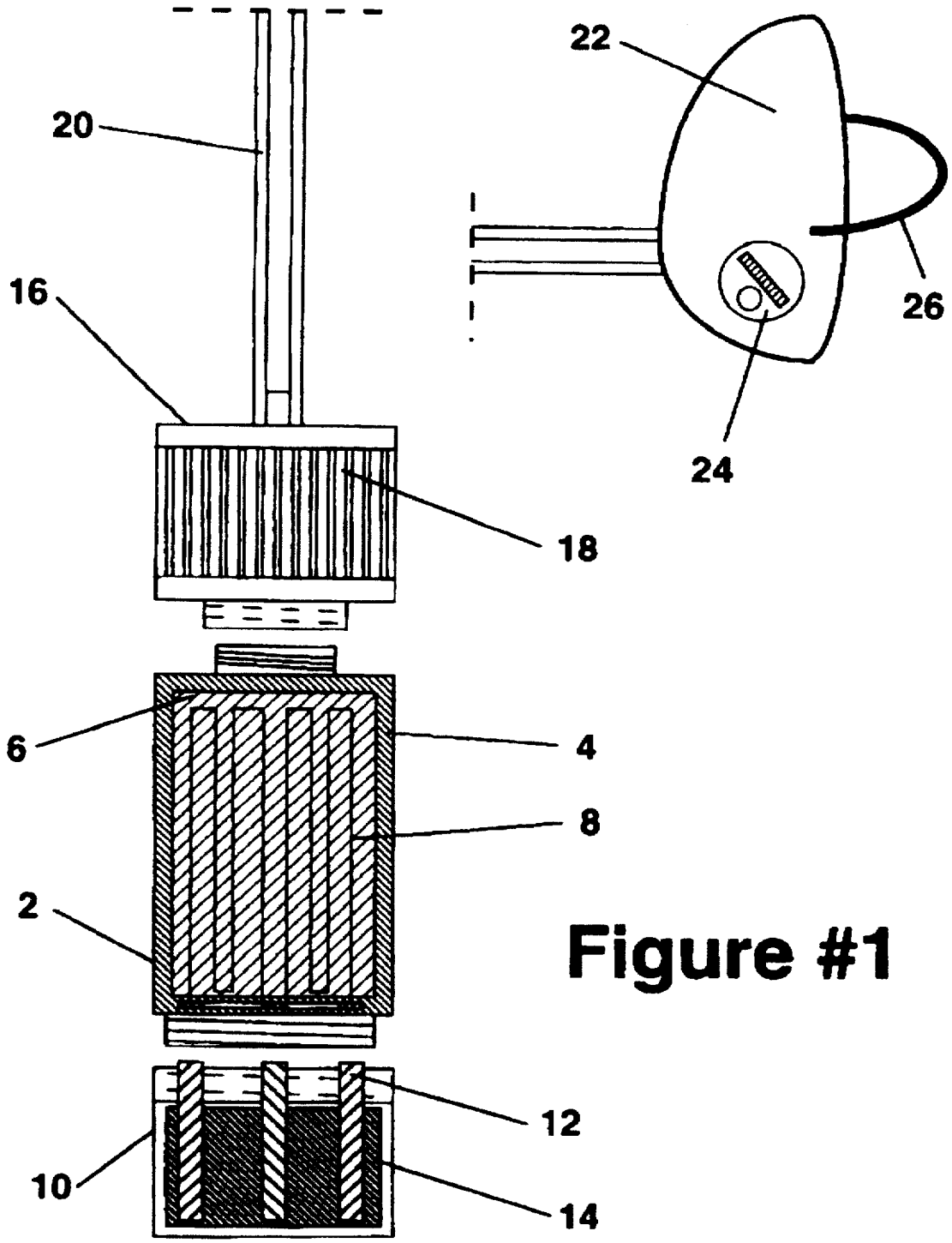
Figure #1

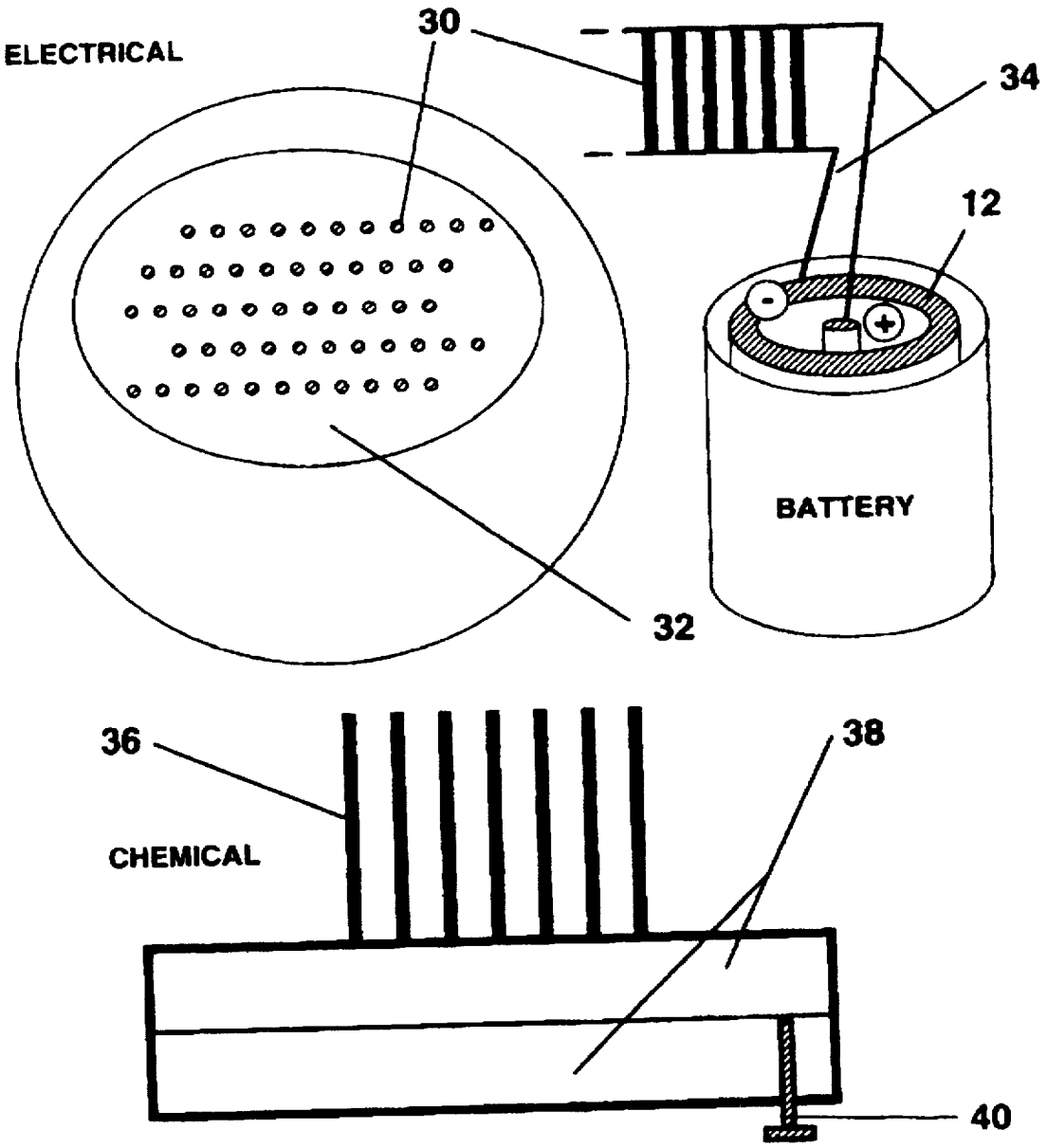
Figure #2

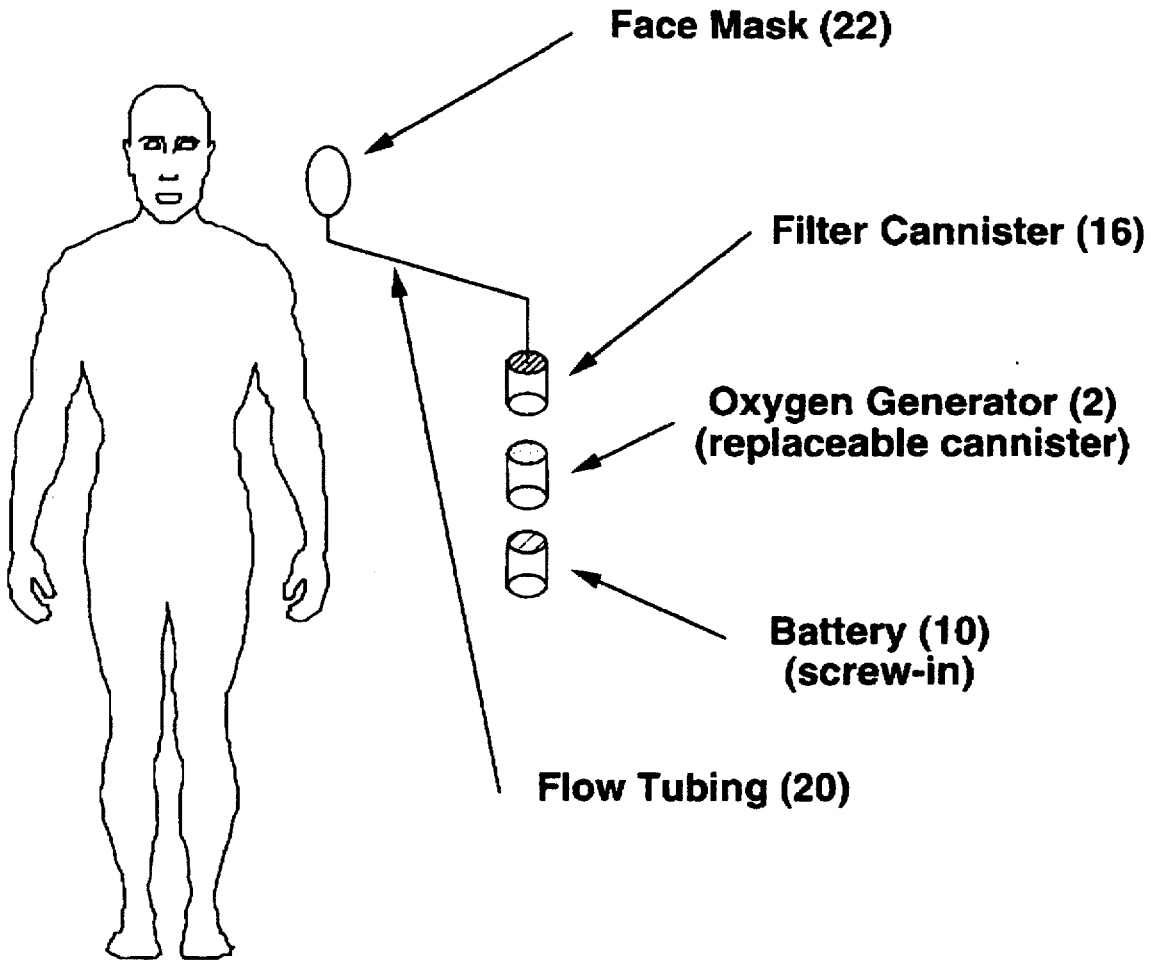
Figure #3

COMPACT MAN-PORTABLE EMERGENCY OXYGEN SUPPLY SYSTEM

BACKGROUND

Portable oxygen generators have been in existence for most of this century. Initial systems utilized compressed oxygen stored in metal cylinders with mechanical regulators to reduce the pressure to ambient levels, and are still in use today. Current medical supply firms provide these generators at a cost of several hundred dollars, and charge for refills. These systems weigh on the order of 5–10 pounds and are approximately 18 inches long and several inches in diameter, with oxygen supplies lasting on the order of 1–3 hours, depending upon the flow rate and concentration.

More recently, liquid oxygen systems have been developed, but these are used mainly for military aircraft and other applications not constrained by weight and power requirements typical of man-portable systems. Finally, there have been several chemical systems that have been developed, mainly for commercial aircraft use, which create oxygen via an exothermic reaction that couples with a reaction in which sodium chlorate is decomposed to oxygen and sodium chloride. These systems can be inadvertently be activated by mechanical agitation, and also require very high temperatures for the decomposition reaction. There are also some laboratory reactions which produce oxygen but which typically require a Bunsen burner to provide the heat for the decomposition reaction, usually over 400 degrees Celsius. Some of these reactions involve toxic materials such as mercury or hydroxides.

The systems currently available all suffer from limitations unique to small portable applications, namely weight/size, cost for acquisition and maintenance, or the presence of toxic chemicals. The present invention is designed to make significant improvements in all these areas to provide a marketable emergency portable oxygen supply system for a variety of applications.

SUMMARY OF THE INVENTION

This device uses a simple chemical reaction, in conjunction with an innovative heating system and advanced insulation techniques to produce oxygen for short periods of time in sufficient quantities to provide for emergency situations requiring a breathable atmosphere, such as fires or medical situations such as a heart attack. The reaction utilized is:

$$2\,KClO_3 \xrightarrow[MnO_2 + 200^\circ C.]{} 2\,KCl + 3\,O_2$$

The appropriate atomic weights for the above reaction are as follows: O=16, K=39.1, Cl=35.5, $KClO_3$=122.6, KCl=74.6 and $O_2$=32. Using these numbers, one can calculate that about two grams of $KClO_3$ will produce about 0.79 grams of oxygen or roughly 0.55 liters at STP, using the well known equality that one Mole of gas at STP equals 22.4 liters. It is known that a normal human intakes about eight liters of air per minute in the breathing process. Thus, if one assumes that it is pure oxygen, one would need about 3.6 grams of $KClO_3$ per liter of $O_2$ or 29 grams per minute. For a ten minute nominal time one would need almost 300 grams, which is approximately 0.7 pounds in weight.

The device design can have a plug-in or integrated capsule to heat the potassium chlorate and manganese dioxide (about 8% additional weight) to produce the oxygen. If one assumes that we uniformly raise the entire roughly 300 grams to 200 degrees Celsius, then one can calculate the required energy using the formula:

$$Q=mC_pdT$$

where the mass m is 300 grams, the specific heat $C_p$ is assumed to be 0.5 and the temperature difference is 200 degrees. This results in a total calorie requirement of about 30,000 calories, which is equivalent to about 125,000 Joules. Similar calculations can be made for other well know laboratory endothermic or low enthalpy change chemically catalyzed reactions including chlorates, nitrates and oxides to determine the size of the energy source needed to allow the molecular oxygen producing reaction to be maintained. If one wants the reaction to proceed in about 60 seconds then the power requirement for the battery system is approximately 125,000/60 or about 2100 watts. If a "nominal", battery capacity is about 25 watt-hr/lb then the battery would be exhausted in about a minute, which is consistent with the time required to generate the flow of oxygen. The battery weight can also be estimated as follows. If one assumes a 10 volt battery with a 10 ohm heater coil, then the current flow is about 1 amp. This results in a Coulomb transfer of 1.0 amp ×96,519×60 seconds or about 5.8 E+6 Coulombs. If we assume a copper-based battery, then the equivalent weight required per Coulomb is $Z_{eq}$=3.3 E−4 grams/Coulomb. This results in a battery weight of four pounds. One could of course heat only a portion of the total reactant initially thus requiring less battery weight, or use a self contained exothermic chemical reaction for heating purposes. Thus a conservative estimate of the weight of the device, about several pounds for an electrically driven system. Additional weight would be added for a filter and face mask/tubing, but could be kept small by using light weight plastic materials.

DESCRIPTION OF THE DRAWINGS

FIG. 1 shows the major components of the portable emergency oxygen supply device.

FIG. 2 illustrates the geometry of the heating "fingers" and the electrical and thermal power systems providing the energy for heating the reactants.

FIG. 3 shows a nominal cylindrical system design and relative sizing for a man-portable system.

DETAILED DESCRIPTION OF PREFERRED EMBODIMENTS

The basic design of the portable emergency oxygen supply device is shown in FIG. 1. A reactant canister 2 contains a "space-age" low volume, low weight insulation composite 4 along with a reactant chamber 6 containing potassium chlorate mixed with a manganese dioxide catalyst (at a concentration of about 8% by weight). The reactant volume is filled with heating "fingers" 8 which raise the temperature of the reactants to the 200 degree Celsius level necessary for the decomposition reaction liberating oxygen to take place. A second screw-on canister 10 contains the battery system necessary to supply energy to the heating fingers for the electrical heating option. The electrode structure 12 and electrolyte material 14 are shown along with a top view of the battery canister. A third screw-on canister 16 contains a carbon filter 18 to remove any impurities or reactant leak-through that might result from the reaction, and also functions to reduce the oxygen temperature via a heat-transfer process based on the flow geometry. Alternate designs may contain an additional capillary radiator and/or a fluid reservoir cooling system, depending on weight and volume constraints. Flexible tubing 20 allows the oxygen to flow to a face mask 22 which contains a mechanism 24 which allows the user to control the amount of ambient atmosphere that can mix with the incoming oxygen from the reactant canister/filter combination. When toxic gases are present, the device can prevent outside air from entering. The mask is held in place with a conventional elastic strap 26. Alternately, an additional carbon filter can be supplied to allow filtered or purified outside air to mix with the oxygen produced by the device.

FIG. 2 provides design details on the heating finger geometry necessary to efficiently bring the reactants to the proper temperature to allow the decomposition reaction to occur. The top portion of the figure shows an electrical heating system, consisting of a resistance heating wire substance 30 surrounded by the reactant mixture 32. A battery source provides for connection of electrode leads 34 for current flow, which are attached to the top and bottom of the resistance heater rods. The heating rods are distributed throughout the reactant for rapid heating of the reactant, which is designed to allow oxygen to quickly diffuse out to the filter canister 16.

The bottom portion of the figure shows a configuration for a chemical heating system. This technique utilizes a similar arrangement of heating fingers 36, but these are solid material of high thermal conductivity to transport the heat from the thermal reaction chambers 38 to the oxygen reactant mixture. These thermal reaction chambers are designed to withstand the temperatures and pressures necessary to heat the fingers to 200 degrees Celsius. The thermal reaction itself is produced by the mixing of two chemicals that react to produce an exothermic heating source. The mixing is initiated by rupturing a seal between the reaction chambers containing the two chemicals, for example by an actuator pin 40. The thermal reaction chambers assembly is surrounded by insulation to minimize heat leakage to the outer reactant canister with a similar configuration as that used for the oxygen reaction chamber. The insulation can be a composite of metallized thin film (to reflect thermal energy) interspersed with light-weight low conductivity foams. This technology has been well developed in the spacecraft thermal control area, where thermal balance with light weight materials is essential.

Finally, FIG. 3 shows a pseudo-assembly drawing to provide a sizing scale for a light weight, man-portable device. A belt or clip-on device will allow the oxygen apparatus to be carried and used without impeding the use of the person's hands.

Although very specific designs have been described in this specification, they are not intended to limit the scope of this invention as defined in the following claims language.

What is claimed is:

1. A light weight man-portable emergency oxygen generator device comprising: a reaction canister means to contain catalyzed reaction products and the input thermal energy necessary to maintain a molecular oxygen producing reaction; chemical composition for producing said molecular oxygen, which undergo chemically catalyzed endothermic or low enthalpy change reactions which are not self-sustaining; separate energy means to create temperature levels sufficient to allow chemical compounds to undergo said chemically catalyzed endothermic or low enthalpy change reactions to produce said molecular oxygen; separate filter means to collect and cool said molecular oxygen from other products produced by said catalyzed reactions; and means to control both the concentration of said molecular oxygen by mixing with ambient air, and the delivery of a breathable atmosphere to people in emergency situations by said oxygen generator device.

2. A device according to claim 1, wherein said separate energy means includes high energy density batteries of the order of 25 watt-hr/lb. per 300 grams of said chemical composition, which allow said temperature levels to be reached by resistance heating of the entire quantity of said chemical composition and sustained, to enable said catalyzed oxygen reactions to proceed or; a separate thermal reaction chamber containing exothermic chemical reactants which provide a heat source which allow said temperature levels to be reached by conductive heating of the entire quantity for said chemical composition enabling said catalyzed oxygen reactions to proceed.

3. A device according to claim 1, wherein said device includes separate filter means comprising materials to remove particulate matter and impurities from said produced oxygen and cool said produced oxygen by thermal conduction and pressure differentials created within said filter and by mixing the oxygen with ambient air in non-toxic environments.

4. A device according to claim 1 wherein said device is light weight and compact for man-portable applications, with reaction chamber, energy source and filter canisters combined weight less than 3–5 pounds and dimensions less than 12 inches in length and three inches in diameter.

5. A device according to claim 1, wherein said separate energy means is easily connected and disconnected from said chemical composition.

6. A device according to claim 1 wherein said reaction chamber contains insulating layers to maintain the external canister temperature of the reaction chamber and associated components within 30 degrees Fahrenheit of the ambient temperature.

7. A device according to claim 1, wherein said reaction canister includes insulating layers.

8. A device according to claim 1, wherein said separate energy means comprises uniformly spaced heating rods, which can be simultaneously or sequentially energized.

9. A device according to claim 1, wherein said chemical composition comprises catalyzed alkali chlorates, alkali nitrates, or alkali oxides.

10. A device according to claim 9, wherein one of said catalyzed alkali chlorates is potassium chlorate mixed with manganese dioxide.

* * * * *